US006059564A

United States Patent [19]

Morris

[11] Patent Number: 6,059,564

[45] Date of Patent: May 9, 2000

[54] CANDLE WITH EMBEDDED GLASS

[75] Inventor: Matthew T. Morris, Santa Monica, Calif.

[73] Assignee: Archipelago, Inc., Los Angeles, Calif.

[21] Appl. No.: 09/273,902

[22] Filed: Mar. 22, 1999

Related U.S. Application Data

[63] Continuation-in-part of application No. 09/033,262, Mar. 2, 1998, abandoned.

[51] Int. Cl.[7] ..... F23D 3/16

[52] U.S. Cl. ..... 431/291; 362/161

[58] Field of Search ..... 362/161; 431/291

[56] References Cited

U.S. PATENT DOCUMENTS

| | | | |
|---|---|---|---|
| 3,286,492 | 11/1966 | Frazier | 431/291 |
| 3,560,240 | 2/1971 | Simmons | 431/291 |
| 3,741,711 | 6/1973 | Bryant | 431/291 |
| 4,017,729 | 4/1977 | Frazier | 431/291 |
| 4,917,597 | 4/1990 | Henze | 431/291 |
| 5,697,694 | 12/1997 | Cutts | 431/291 |

*Primary Examiner*—Carroll Dority
*Attorney, Agent, or Firm*—Nikolai, Mersereau & Dietz, P.A.

[57] ABSTRACT

A wax body made of a translucent wax forms a candle holder. A glass holder is embedded in the wax body to receive a candle. The candle is either formed within the glass holder or is is formed separately as a replacement candle for the glass holder. A decorative paper is secured to the wax body exterior. A translucent wax layer covers the exterior of the decorative paper.

11 Claims, 2 Drawing Sheets

CANDLE WITH EMBEDDED GLASS

CROSS-REFERENCE TO RELATED APPLICATIONS

This patent application is a continuation-in-part of application Ser. No. 09/033,262, filed Mar. 2, 1998 and now abandoned.

BACKGROUND OF THE INVENTION

I. Field of the Invention

This invention relates to candles and more particularly to a wax candle holder with an embedded glass holder surrounding a candle.

II. Discussion of the Related Art

Over the years, candles have been used for a variety of purposes from functional lighting to ornamental lighting. As a result of the long and varied use, a variety of candles have developed from thin elongated tapers to stout cylindrical candles to small votive candles. Many candles are used with a candle holder to support the candle. Candle holders have ranged from traditional candle stick holders to luminaries made from paper bags.

Candles are now commonly used for ornamental lighting and as a result have become more decorative. Designs made from colored waxes, embedding flowers or other surface ornamentation in the candle wax, and sculpting or cutting designs into the candle wax are typically types of ornamentation. Occasionally, the surface ornamentation can break off, disappear or be destroyed, especially as the candle burns down, deforming its walls and the ornamentation therein.

The glare or bright light from a candle flame can be undesirable and as a result candle holders were developed to minimize the glare or create a particular illumination. Candles are often placed in protective globes, often glass globes, or enclosed lanterns to create a particular illumination effect while at the same time protecting the flame from being blown out or accidentally catching something on fire. Tinted glass containers are the most common way to reduce the glare, although the glass containers can easily be knocked over and broken. The protective coverings also become dirty after extended use.

One problem that exists with candles, and particularly large cylindrical candles, is that as the candle burns, the upper outer wax area becomes deformed from the heat generated by the flame. Thus, not only is there the glare from the flame, but the candle becomes unattractive and deformed as the candle burns and the wax melts. Thus, what is needed is a candle that does not deform its decorative exterior as it burns and does not have excessive glare from the flame but instead has a glowing illumination effect.

SUMMARY OF THE INVENTION

The present invention is a candle that creates a glowing illumination effect without deforming the decorative portion by providing its own candle holder in the form of a decorative wax cylinder covering a glass embedded holder for a candle. The candle is either formed within the glass embedded holder or it is inserted into the glass embedded holder. The exterior wax holder has a decorative paper wrapped around it that is then coated with a layer of wax.

OBJECTS

It is accordingly a principle object of the present invention to provide a decorative candle holder consisting of a glass holder embedded in wax and a candle received within the glass of the candle holder for creating a glowing illumination effect of a candle and candle holder without deforming the sides of the decorative candle holder as the candle burns down into the interior of glass holder embedded in the candle holder.

Another object of the present invention is to provide a candle holder and candle that has a glowing appearance because an inner candle illuminates its candle holder made from wax.

A further object of the present invention is to provide candle holder made of wax having an integral candle that is formed within a glass holder embedded in the candle holder.

Still another object of the present invention is to provide a candle holder made from wax and an embedded glass holder with waxed coated decorative paper secured to the exterior of the holder to enhance the glowing illumination effect of the candle flame within the candle holder.

Yet another object of the present invention is to provide a candle holder made from scented wax and an embedded glass holder with waxed coated decorative paper secured to the exterior of the holder to enhance the glowing illumination effect of the candle flame within the candle holder.

These and other objects, as well as these and other features and advantages of the present invention will become readily apparent to those skilled in the art from a review of the following detailed description of the preferred embodiment in conjunction with the accompanying claims and drawings in which like numerals in the several views refer to corresponding parts.

DETAILED DESCRIPTION

Figure 1:
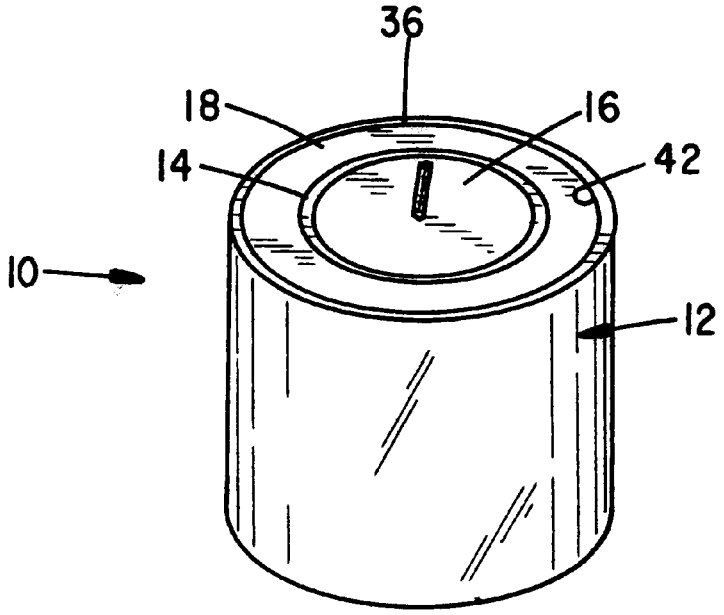
FIG. 1 is a perspective view of candle of the present invention.

The candle of the present invention is designated 10 in FIG. 1. Candle 10 includes an exterior wax holder 12 with a glass holder 14 embedded in the exterior wax holder and a candle 16.

Figure 2:
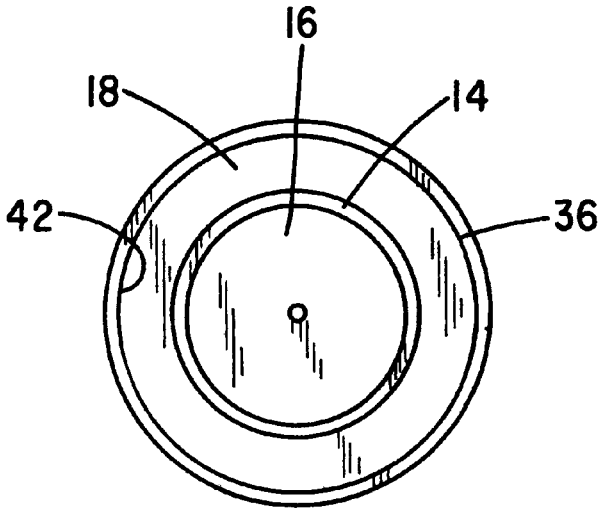
FIG. 2 is a top view of the candle of the present invention.
Figure 3:
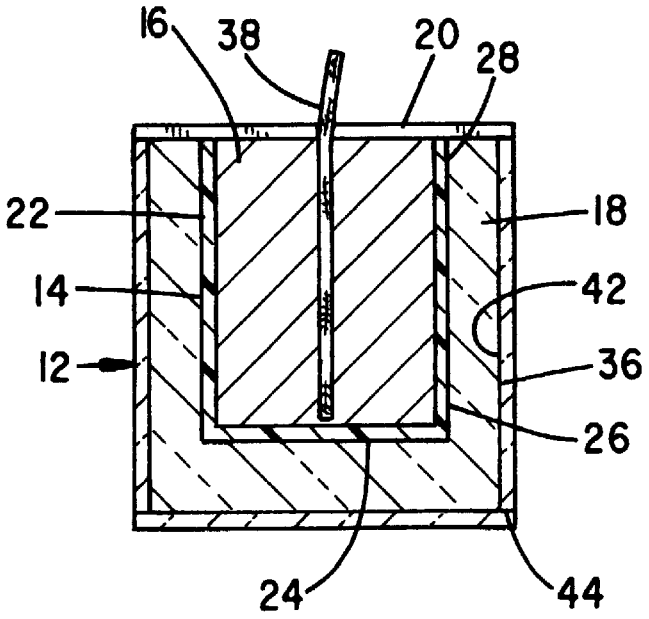
FIG. 3 is a cross sectional view of the candle of the present invention.
Figure 4:
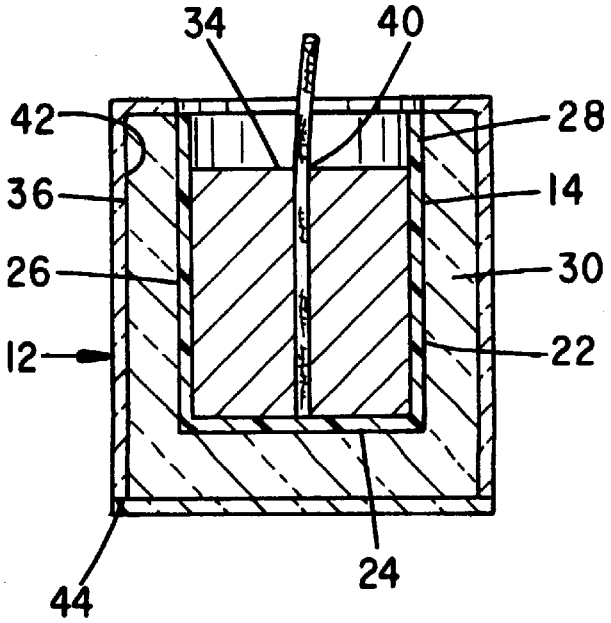
FIG. 4 is a cross sectional view of another embodiment of the present invention.

Turning now to FIGS. 2, 3 and 4, the exterior wax canlde holder 12 will be described in greater detail. The wax holder 12 is formed by forming a wax body 18 around a glass holder 14 having an open top 20, a side wall 22 and base 24. The wax body 18 is preferably one and one half to three fourths inches thick around the exterior glass surface 26 of side wall 22. The wax body 18 is approximately one half to two inches thick from the base 24. The wax body 18 is formed such that the glass holder 14 cannot be removed from the bore defined by the wax body 18. In the first embodiment shown in FIG. 3, the wax body 18 is flush with the upper edge 28 of the glass holder 14. In the second embodiment shown in FIG. 4, the wax body 30 extends past the top of the upper edge 28 of glass holder 14.

The candle 16 likewise has two embodiments. In the first embodiment shown in FIG. 3, the candle 16 is conventionally formed in the glass holder 14 and has a conventional wick 38. In a second embodiment shown in FIG. 4, the candle 34 is formed separate as an insert for the glass holder 14 and has a conventional wick 40. Thus, when a candle 16 or 34 is used up, a new replacement candle 34 can be placed in the glass container 14 to replace the used candle 16 or 34.

The wax body 18 or 30 is preferably translucent or white in color to assist in illumination when candle 16 or 34 is lit. The wax may also be scented. A decorative paper 36 is secured around the side wall 42 of the wax holder 12. The paper 36 is preferably translucent, colored, and decorative, such as lemon grass paper. The paper 36 is first conventionally secured to the wax holder 12. The wax holder 12 and paper 36 is then coated with a layer of semi-transparent material 44, such as varnish, shellac or a plastic. In the first candle embodiment shown in FIG. 3, the entire exterior of the candle holder 12, upper edge 28 of the glass holder 14 and candle 16 is coated with the semi-transparent layer 44. In the second embodiment, the interior of the glass container is not coated with the semi-transparent layer 44.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. A candle and candle holder comprising:

a) a wax body made of a translucent wax;

b) a glass holder having a lower surface, a side wall and an open top, said glass holder entirely embedded along its side walls in said wax body;

c) a candle located within said glass holder;

d) a decorative paper secured to and surrounding said wax body exterior; and e) a layer of semi-transparent material covering said decorative paper.

2. A candle and candle holder of claim 1 wherein said candle is formed separate from said glass holder.

3. A candle and candle holder of claim 1 wherein said candle is formed within said glass holder.

4. A candle and candle holder of claim 1 wherein said decorative paper is lemon grass paper.

5. A candle and candle holder of claim 1 wherein said decorative paper is translucent.

6. A candle and candle holder of claim 1 wherein said wax body extends above an upper edge of said glass holder.

7. A candle and candle holder of claim 1 wherein the layer of semi-transparent material is selected from a group consisting of wax, varnish, shellac and plastic.

8. A candle holder comprising:

(a) a hollow body made of a translucent material and adapted to hold a transparent container having a candle located within the transparent container, the container being entirely embedded within the translucent material of the hollow body;

(b) a decorative paper secured to and surrounding said hollow body exterior; and (c) a layer of semi-transparent material covering said decorative paper.

9. The candle holder of claim 8 wherein the decorative paper is lemon grass paper.

10. A candle holder as in claim 8 wherein the layer of semi-transparent material is selected from a group consisting of wax, varnish, shellac and plastic.

11. The candle holder of claim 8 wherein the translucent material comprising the hollow body is selected from a group consisting of wax, glass and plastic.

* * * * *